US009905068B2

(12) United States Patent
Stirtz

(10) Patent No.: US 9,905,068 B2
(45) Date of Patent: Feb. 27, 2018

(54) KEY FOB WITH FOAM LOCK STATUS INDICATOR

(71) Applicant: Ronald H. Stirtz, Creswell, OR (US)

(72) Inventor: Ronald H. Stirtz, Creswell, OR (US)

( * ) Notice: Subject to any disclaimer, the term of this patent is extended or adjusted under 35 U.S.C. 154(b) by 0 days.

(21) Appl. No.: 14/999,557

(22) Filed: May 23, 2016

(65) Prior Publication Data

US 2017/0337760 A1 Nov. 23, 2017

(51) Int. Cl.
*G07C 9/00* (2006.01)
*H01H 9/02* (2006.01)

(52) U.S. Cl.
CPC ..... *G07C 9/00944* (2013.01); *H01H 9/0235* (2013.01); *G07C 2009/00984* (2013.01)

(58) Field of Classification Search
None
See application file for complete search history.

(56) References Cited

U.S. PATENT DOCUMENTS

2007/0262848 A1* 11/2007 Berstis ..... G07C 9/00944 340/3.9
2010/0300461 A1* 12/2010 Gilder ..... A61F 11/08 128/864
2014/0272307 A1* 9/2014 Sas ..... C09J 7/0296 428/159
2014/0366249 A1* 12/2014 West ..... A44C 3/001 2/244

* cited by examiner

*Primary Examiner* — Leon-Viet Nguyen
(74) *Attorney, Agent, or Firm* — Robert E. Howard

(57) ABSTRACT

A lock button status indicator member for use with a key fob having a depressable lock button for remotely activating a locking mechanism communicating with a door. The lock button status indicator member is formed of a viscoelastic polyurethane foam having a slow recovery time. The lock button status indicator member has a base configured to abut the upper surface of the lock button. An adherent, such as a pressure sensitive adhesive, is located on the lower surface of the base of the lock button status indicator member, and is adapted to adhere the lower surface of the base to the upper surface of the lock button.

15 Claims, 1 Drawing Sheet

Fig. 1 *(PRIOR ART)*
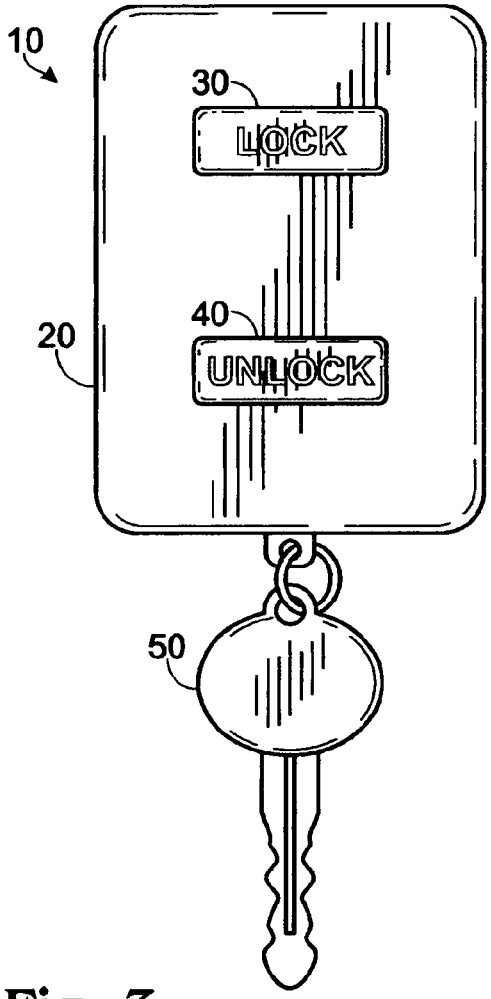
Fig. 2
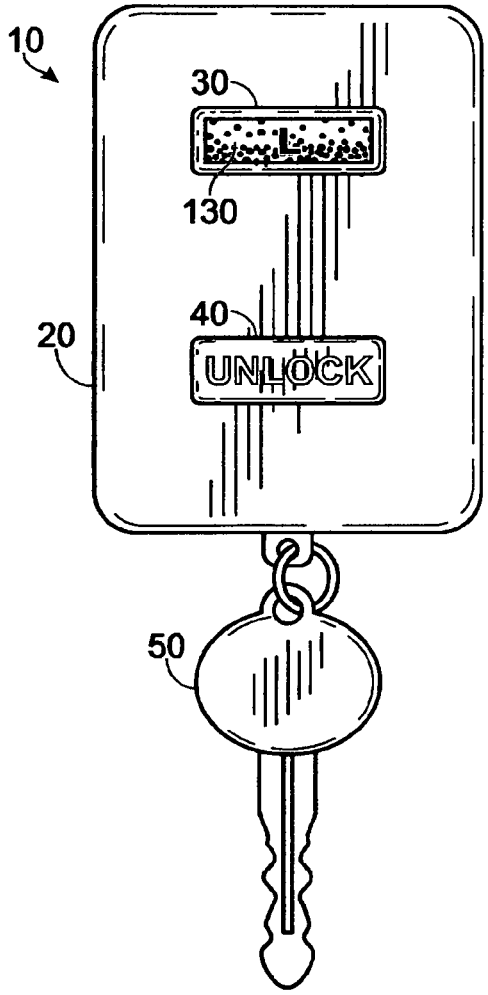
Fig. 3
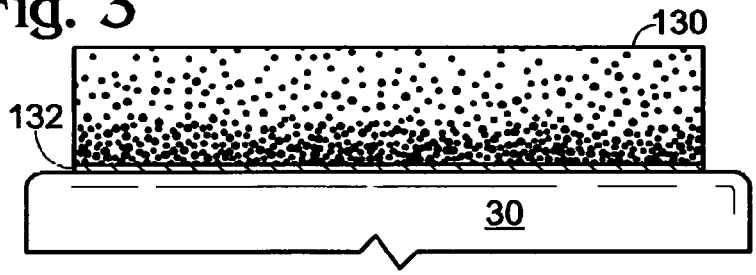
Fig. 4
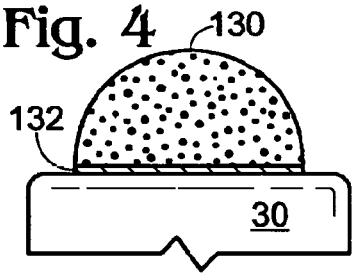
Fig. 5
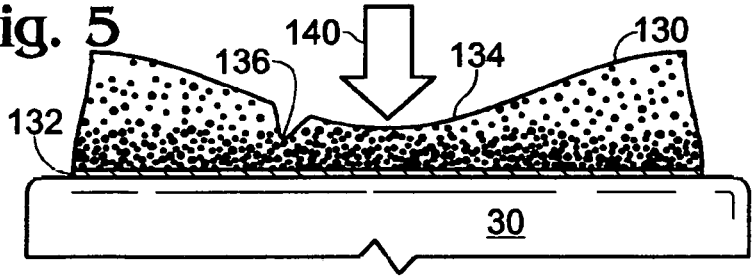

KEY FOB WITH FOAM LOCK STATUS INDICATOR

BACKGROUND OF THE INVENTION

The present invention relates to a lock status indicator for a key fob used for remotely locking and unlocking a vehicle door that informs the user for a limited period of time after having left the vicinity of the vehicle whether the door lock button had been depressed to actuate the door lock.

The use of key fobs for remotely locking and unlocking vehicle doors has become almost universal. In its simplest form the key fob is a hand held device having a depressable button labeled "lock" or some similar label, and another depressable button labeled "unlock" or some similar label. Located within the key fob are the electronics and power source required to transmit a signal via a modulated radio frequency or via infrared to a receiver communicating with the lock/unlock mechanism of a door or doors of a vehicle upon depression of the "lock" or "unlock" button. Additional buttons, such as a "panic" button for activating the vehicle's horn as an alarm, may also be present.

After parking a vehicle and walking away to perform an errand, or for other reasons, a user may not remember whether the vehicle's door was locked at the time of departure by having depressed the "lock" button of the key fob. Rather than having to walk back towards the vehicle into a proximity where the lock button can be depressed to insure activation of the door lock, it would be desirable to have some indicator means associated with the fob itself to inform the user as to whether the lock button had indeed been depressed upon departing the vehicle.

There have been several suggestions in the prior art for ways for a key fob to indicate the status of a door lock. Most are complex and expensive, involving electronic communication between a sensor in the door and a receiver in the fob. See, for example, U.S. Pat. No. 8,362,898.

SUMMARY OF THE INVENTION

It is an object of the present invention to provide a simple and inexpensive lock button status indicator member for use with a key fob having a depressable lock button for remotely activating a locking mechanism communicating with a door, such as a vehicle door.

The lock button status indicator member is formed of a viscoelastic polyurethane foam having a slow recovery time.

The lock button status indicator member has a base configured to abut the upper surface of the lock button, but is of a size that does not interfere with depression of the lock button into the key fob case.

An adherent, such as a pressure sensitive adhesive, is located on the lower surface of the base of the lock button status indicator member, and is adapted to adhere the lower surface of the base to the upper surface of the lock button.

The lock button status indicator member can inform the user for a limited period of time after having left a vehicle whether the lock button on the key fob had been depressed to actuate the door lock.

BRIEF DESCRIPTION OF THE DRAWINGS

FIG. 1 is a front view of a prior art key fob;

FIG. 2 is a front view of the key fob of the present invention with a status indicator member attached to the upper surface of the "lock" button FIG. 3 is a side view of the lock button and attached status indicator member of the key fob of the present invention;

FIG. 4 is an end view of the lock button and attached status indicator member of the key fob of the present invention; and FIG. 5 is a side view of the lock button with attached status indicator member of the key fob of the present invention with the status indicator shown in a depressed mode.

DESCRIPTION OF PREFERRED EMBODIMENTS

A generic prior art vehicle key fob 10 is illustrated in FIG. 1.

Key fob 10 has a case 20 which contains the electronics and power source (not shown) required to transmit a signal via a modulated radio frequency or via infrared to a receiver communicating with the lock/unlock mechanism of a door or doors of a vehicle upon depression of the "lock" or "unlock" button to lock or unlock a door or doors of a vehicle. Such elements are well known in the vehicle key fob art.

Key fob 10 has a "lock" function button 30 and an "unlock" function button 40. Prior art key fobs typically have a "panic" button and other buttons, not shown. A vehicle ignition key 50 is attached to fob 10, although with some vehicles, such as Mercedes Benz, a portion of the fob itself forms an electronic key for insertion into the ignition.

In FIG. 1 the generally rectangular shape of fob 10, and the arrangement and shape of the various buttons on fob 10, is for discussion purposes only as prior art fobs come in many different shapes and the various buttons located thereon take other arrangements or forms. Additional buttons for other functions may also be located thereon, as known in the prior art. Some prior art fobs use symbols to identify the function of the various buttons rather than the words such as "lock", "unlock", etc.

The lock status indicator member 130 of the present invention, described in detail below, can be used as an after-market add-on to any existing prior art key fob which, as discussed above, can take many different shapes, button arrangements, and button identifiers. For purpose of describing the invention, the generic key fob 10 illustrated in FIG. 1 is used as the key fob with which the lock status indicator member 130 of the present invention is employed.

FIG. 2 shows the key fob 10 of FIG. 1 to which a lock button status indicator member 130 has been added. The lower surface of the base of status indicator member 130 is attached to the upper surface of lock button 30 by means of a pressure sensitive adhesive 132, or other adherent or attachment means, as best seen in FIGS. 3 and 4.

Status indicator member 130 is shown as having a substantially semi-circular cross-section in FIG. 4; however, other cross-sections may be employed.

Status indicator member 130 is shown as having a substantially rectangular base in FIGS. 2-4, which mirrors the substantially rectangular shape of lock button 30. However, other base shapes may be employed, particularly those that mirror the shape of a particular commercially used lock button such as, for example, substantially circular.

Whatever shape is chosen for the base of the status indicator member 130, its edge (if circular) or edges (if rectangular or other polygon) should not extend beyond the adjacent edge or edges of the upper surface of lock button 30, and preferably is located inwardly therefrom as seen in FIGS. 2-5, so as not to interfere with the depression of lock button 30 into case 20 when it is actuated.

Since status indicator member 130 will substantially or entirely cover the word "lock" or other indicia on the upper surface of lock button 30, the word "lock", the letter "L", or other indicia can be printed on the upper surface of status indicator member 130 to indicate that the lock button 30 resides below.

Status indicator member 130 is formed of a viscoelastic polyurethane foam, commonly called "memory foam". Memory foam has an open-cell solid structure that forms an indentation when subjected to a force acting against its surface and slowly returns to its original shape once the force is released. The time required to return to its original shape is referred to as its "recovery time". Commercially available memory foam can have recovery times that range from very slow to extremely fast.

For purposes of the present invention, a memory foam is selected having a slow recovery time rather than a fast recovery time in order to maximize the time available for it to act as a status indicator, as discussed below. The selection of a memory foam having a slow recovery time from among those commercially available is well within the scope of one skilled in the memory foam art. The thickness or height of status indicator member 130 should be such as to, in conjunction with the properties of the memory foam selected, provide a reasonable recovery time for the status indicator purposes described herein.

Status indicator member 130 formed of memory foam is attached to lock button 30 of a key fob, as discussed above. Upon exiting a vehicle, the user depresses the lock button 30 by depressing status indicator member 130 attached to the upper surface thereof with a finger or thumb. As seen in FIG. 5, the downward force 140 of the user's finger or thumb acting upon the upper surface of status indicator member 130 forms an indentation 134 which only slowly returns to its original shape because the memory foam from which it has been made has been selected to have a slow recovery time. Recovery times of about 2-3 minutes are readily achievable. Involving a finger or thumb nail in depressing status indicator member 130 would form a crease 136 in the bottom of the finger or thumb indentation 134, providing a somewhat lengthier recovery time of up to about 5 minutes.

Instructions provided with status indicator member 130 could specify a recovery time beyond which status indicator member 130 would no longer provide the user with information as to whether the lock button 30 had been depressed after departure from the vehicle. Alternatively, the user could determine the recovery time for his/her specific fob and finger pressure by depressing status indicator member 130 and measuring the time it takes for the indentation 134 or 136 to fully disappear.

The user, after having walked away from his/her vehicle, but while still within the recovery time of status indicator member 130, can glance at key fob 10 and see if status indicator member 130 remains somewhat indented, i.e., has not fully recovered its original shape, thereby confirming activation of lock button 30. Lack of any remaining portion of indentation 134 or 136 within the recovery time of status indicator member 130 indicates that lock button 30 was not depressed and that the vehicle's door(s) remain unlocked.

While the invention has been described relative to a key fob 10 for remotely locking and unlocking a vehicle door having a lock button status indicator member 130 attached to the lock button 30, it is clear that the lock button status indicator member 130 of the present invention can be used with a key fob having a lock button for locking doors other than vehicle doors, such as entry and exit doors to buildings, garage doors, internally located security doors, etc.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A key fob comprising a case having a depressible lock button and containing electronics and a power source required to transmit a signal to a receiver communicating with a lock mechanism of a door or doors upon depression of said depressible lock button to thereby cause said door or doors to lock, said depressible lock button having an upper surface; and a lock button status indicator member having a base with a lower surface adhered to said upper surface of said depressible lock button, said lock button status indicator member being formed of a viscoelastic polyurethane foam having a slow recovery time in the range of 2 to 5 minutes.

2. The key fob of claim 1 wherein said base of said lock button status indicator member has an edge or edges that do not extend beyond the adjacent edge or edges of the upper surface of said lock button.

3. The key fob of claim 2 wherein said edge or edges of said base of said lock button status indicator member is or are located inwardly from the adjacent edge or edges of the upper surface of said lock button.

4. The key fob of claim 3 wherein said base of said lock button status indicator member is substantially rectangular in shape.

5. The key fob of claim 4 wherein said lock button status indicator member has a cross-section that is substantially semi-circular.

6. The key fob of claim 1 wherein indicia is applied to the upper surface of said status indicator member to indicate that said lock button is located beneath.

7. The key fob of claim 1 wherein said door is a vehicle door.

8. A key fob comprising:

a case having a depressible lock button, said case containing the electronics and power source required to transmit a signal to a receiver communicating with-the a lock mechanism of a door or doors upon depression of said depressible lock button to thereby cause said door or doors to lock, said depressible lock button having an upper surface;

a lock button status indicator member being formed of a viscoelastic polyurethane foam having a slow recovery time in the range of 2 to 5 minutes;

said lock button status indicator member having a base, said base having a lower surface configured to abut the upper surface of said lock button; and an adherent located on said lower surface of said base of said lock button status indicator member adapted to adhere said lower surface of said base of said lock button status indicator member to said upper surface of said lock button.

9. The lock button status indicator member of claim 8 wherein said adherent is a pressure sensitive adhesive.

10. The key fob of claim 8 wherein said base of said lock button status indicator member has an edge or edges that do not extend beyond the adjacent edge or edges of the upper surface of said lock button.

11. The key fob of claim 10 wherein said edge or edges of said base of said lock button status indicator member is or are located inwardly from the adjacent edge or edges of the upper surface of said lock button.

12. The key fob of claim 11 wherein said base of said lock button status indicator member is substantially rectangular in shape.

13. The key fob of claim 12 wherein said lock button status indicator member has a cross-section that is substantially semi-circular.

14. The key fob of claim 8 wherein indicia is applied to the upper surface of said status indicator member to indicate that said lock button is located beneath.

15. The key fob of claim 8 wherein said door is a vehicle door.

* * * * *